US011116293B2

(12) United States Patent
Karman

(10) Patent No.: US 11,116,293 B2
(45) Date of Patent: Sep. 14, 2021

(54) CLOSURE DEVICE FOR JEWELRY

(71) Applicant: J.K. Manufacturing, Inc., Locust Valley, NY (US)

(72) Inventor: Neil Karman, Tamarac, FL (US)

(73) Assignee: J.K. Manufacturing, Inc., Locust Valley, NY (US)

( * ) Notice: Subject to any disclaimer, the term of this patent is extended or adjusted under 35 U.S.C. 154(b) by 0 days.

(21) Appl. No.: 17/176,348

(22) Filed: Feb. 16, 2021

(65) Prior Publication Data

US 2021/0251351 A1 Aug. 19, 2021

Related U.S. Application Data

(60) Provisional application No. 62/977,595, filed on Feb. 17, 2020.

(51) Int. Cl.
*A44C 7/00* (2006.01)
*A44C 5/14* (2006.01)

(52) U.S. Cl.
CPC ..... *A44C 7/003* (2013.01); *A44C 5/145* (2013.01)

(58) Field of Classification Search
CPC ..... A44C 7/003; A44C 5/145; A44C 7/00; A44C 9/0038; A44C 9/0046; A44C 13/00; A44C 15/0035
See application file for complete search history.

(56) References Cited

U.S. PATENT DOCUMENTS 2,647,379 A * 8/1953 Ferro ..... A44C 7/00 63/12
2,931,195 A * 4/1960 Laflamme ..... A44C 7/00 63/12
3,208,239 A * 9/1965 Pintarelli ..... A44C 7/00 63/12
3,673,815 A * 7/1972 Pintarelli ..... A44C 7/00 63/12
6,581,244 B1 * 6/2003 Peters ..... A44C 7/00 16/386
2002/0045913 A1 * 4/2002 Reil ..... A44C 7/00 606/188
2006/0048541 A1 * 3/2006 Khyvat ..... A44C 7/00 63/12

FOREIGN PATENT DOCUMENTS

CA 2331560 A1 * 11/1999 ..... A44C 7/00
DE 2326451 A1 * 12/1974 ..... A44C 7/00
WO WO-2008067571 A1 * 6/2008 ..... A44C 7/00

* cited by examiner

*Primary Examiner* — Jack W Lavinder
(74) *Attorney, Agent, or Firm* — Johnson & Martin, P.A.; James David Johnson

(57) ABSTRACT

Closure devices for simply and securely fastening items of jewelry, such as hoop earrings and bracelets, to a body of a wearer are described. The closure device includes a post element and a latch. The post element is movably connected to a hinge, wherein the hinge is attached to a first end of an item of jewelry. The latch includes a first and second side wires, which are joined at a closed end to form a loop. The latch is attached to a second end of the item of jewelry. A width of the loop is less than a width of the post element. The closure device secures the item of jewelry to a person by removably but securely connecting between the first and second ends of the item of jewelry by fastening the post element between the first side wire and second side wire of the loop.

17 Claims, 3 Drawing Sheets

CLOSURE DEVICE FOR JEWELRY

CROSS-REFERENCE TO RELATED APPLICATIONS

This application is a nonprovisional application of and claims priority from U.S. provisional patent application Ser. No. 62/977,595 filed on Feb. 17, 2020. The foregoing application is incorporated in its entirety herein by reference.

FIELD OF THE INVENTION

The invention relates to a closure device for jewelry. More particularly, the invention relates to closure devices that function as a connector mechanism for securing jewelry to a person.

BACKGROUND

Generally, jewelry closure mechanisms do not have the innate ability to guarantee that the closure has locked itself into place. Many such closure devices are difficult for a person wearing the jewelry to operate both in closing and opening the closure device so that attachment and removal of an item of jewelry is rendered difficult. Certain types of closure devices also are prone to failure in that they may be difficult for the wearer to ascertain whether the closure device has been effectively closed to ensure that the item of jewelry does not become detached from the wearer's body.

A need exists for closure devices for jewelry that are capable of simply and securely fastening an item of jewelry to a wearer's body.

SUMMARY

The invention relates to closure devices for simply and securely fastening items of jewelry, such as hoop earrings and bracelets, to a body of a person who is a wearer of the jewelry. The closure device includes a post element and a latch. The post element is movably connected to a hinge, wherein the hinge is attached to a first end of an item of jewelry. The latch includes a first side wire and a second side wire, which are joined at a closed end to form a loop. The loop can be linear or straight in shape or it can be curved. In exemplary embodiments, the loop can be U-shaped or V-shaped with the closed end of the loop being oriented away from the post element. The latch is attached to a second end of the item of jewelry. A width of the loop is less than a width of the post element. The closure device secures the item of jewelry to a person by removably but securely connecting between the first and second ends of the item of jewelry by fastening the post element between the first side wire and second side wire of the loop.

The closure device provides an advantage by simply and securely and removably fastening an item of jewelry to a wearer's body. Another advantage of the closure device is that it can be designed so as to be decorative unlike many other traditional closure devices that have been used with jewelry.

Accordingly, the invention features a closure device for securing an item of jewelry to a person. The closure device includes a post element movably connected to a hinge, wherein the hinge is attached to a first end of an item of jewelry. The closure device also includes a latch having a first side wire and a second side wire, which are joined at a closed end to form a loop. The latch is attached to a second end of the item of jewelry. A width of the loop is less than a width of the post element. The closure device secures the item of jewelry to a person by removably but securely connecting between the first end and second end of the item of jewelry by fastening the post element between the first side wire and second side wire of the loop.

In another aspect, the invention can feature the post element including a free end and a fixed end that is connected to the hinge.

In another aspect, the invention can feature the post element being or including a generally linear wire.

In another aspect, the invention can feature the post element including a first curved section and a second curved section, wherein a vertex of the first curved section extends in a first direction, and wherein a vertex of the second curved section extends in a second direction that is opposite to the first direction.

In another aspect, the invention can feature a free end of the post element extending away from an outer surface of the item of jewelry, wherein the outer surface of the item of jewelry faces away from a space that is defined by the item of jewelry when the closure device is manipulated into a closed configuration.

In another aspect, the invention can feature the hinge being attached horizontally through the first end of the item of jewelry.

In another aspect, the invention can feature the first side wire and the second side wire being part of a single wire having a first free end and a second free end, wherein the first and second free ends are attached to the second end of the item of jewelry to form the loop.

In another aspect, the invention can feature the loop being U-shaped or V-shaped; wherein the closed end of the loop is oriented away from the post element.

In another aspect, the invention can feature the first side wire and the second side wire being part of a single wire having a first free end and a second free end. The first and second free ends are attached to the second end of the item of jewelry to form the loop. Each of the first and second side wires extend for first lengths away from their point of attachment to the second end of the item of jewelry toward the first end of the item of jewelry. The first and second side wires each curve at first points of their respective first lengths to form curved second lengths. The curved second lengths of the first and second side wires each continue from second points to form third lengths oriented in a direction opposite to the direction of their respective first lengths. At third points, the third lengths curve at arcs in a plane that is perpendicular to planes extending through the first lengths and third lengths of each of the first and second side wires. The third lengths connect together to complete the loop, thereby forming the closed end of the latch.

In another aspect, the invention can feature the closed end of the loop of the latch being oriented away from the first end of the item of jewelry.

In another aspect, the invention can feature the loop and closed end of the latch defining a receiving aperture into which the post element is insertable to place the closure device into a closed configuration.

In another aspect, the invention can feature the item of jewelry being or including an earring, a bracelet, a necklace, or any other item of jewelry having first and second ends that require closure to secure the item of jewelry to the person.

In another aspect, the invention can feature the item of jewelry being an earring, wherein the post element is insertable through a piercing on the body of the person.

The invention also features an item of jewelry that is an item of jewelry having a first end and a second end. The item of jewelry also includes a post element movably connected to a hinge, wherein the hinge is attached to the first end of the item of jewelry. The item of jewelry further includes a latch having a first side wire and a second side wire, which are joined at a closed end to form a loop. The latch is attached to a second end of the item of jewelry. A width of the loop is less than a width of the post element. The closure device secures the item of jewelry to a person by removably but securely connecting between the first end and second end of the item of jewelry by fastening the post element between the first side wire and second side wire of the loop.

In another aspect, the invention can feature the post element including a free end and a fixed end that is connected to the hinge.

In another aspect, the invention can feature the post element including a first curved section and a second curved section, wherein a vertex of the first curved section extends in a first direction, and wherein a vertex of the second curved section extends in a second direction that is opposite to the first direction.

In another aspect, the invention can feature a free end of the post element extending away from an outer surface of the item of jewelry, wherein the outer surface of the item of jewelry faces away from a space that is defined by the item of jewelry when the closure device is manipulated into a closed configuration.

In another aspect, the invention can feature the first side wire and the second side wire being part of a single wire having a first free end and a second free end, wherein the first and second free ends are attached to the second end of the item of jewelry to form the loop.

In another aspect, the invention can feature the loop being U-shaped or V-shaped, wherein the closed end of the loop of the latch is oriented away from the first end of the item of jewelry.

In another aspect, the invention can feature the loop and closed end of the latch defining a receiving aperture into which the post element is insertable to place the closure device into a closed configuration.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
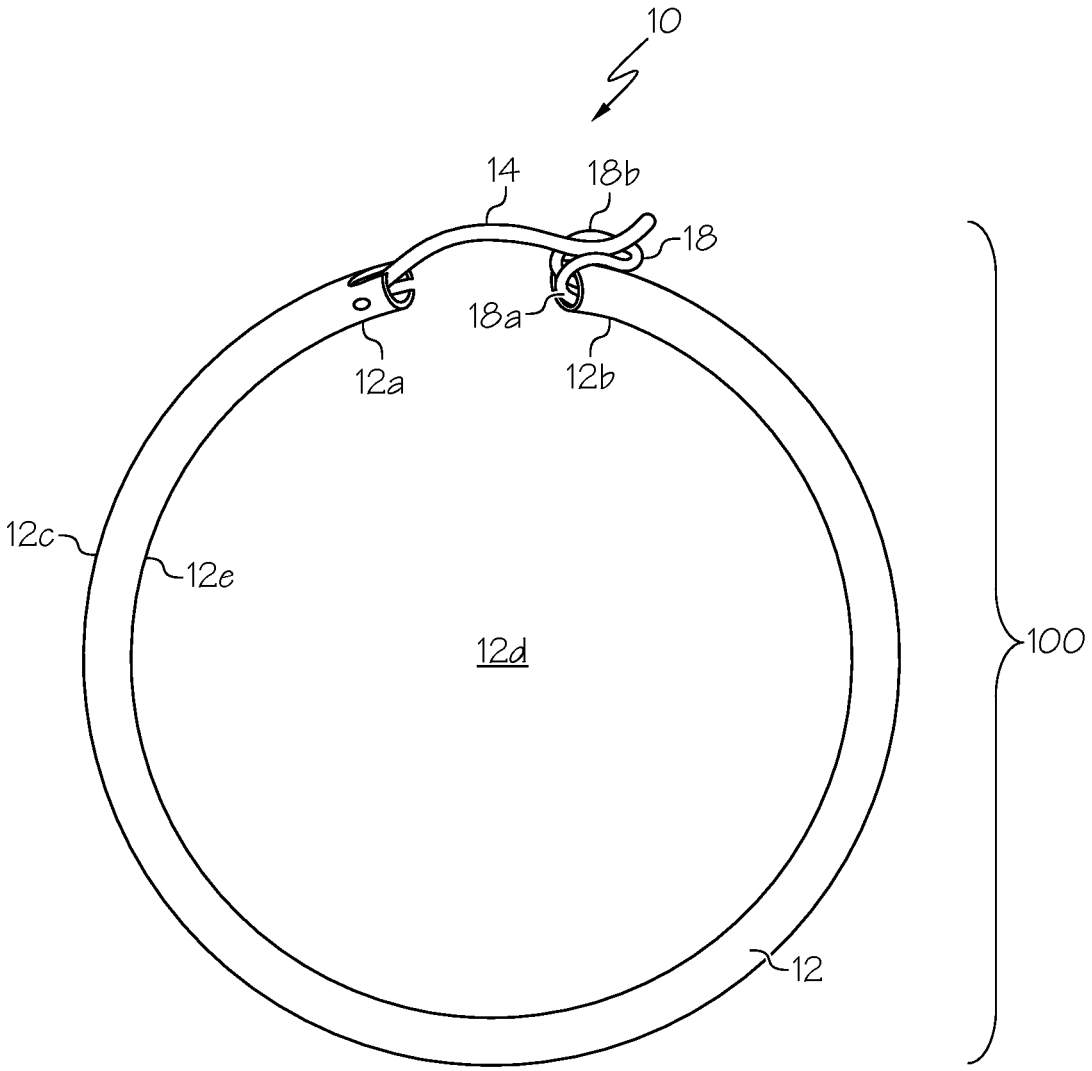
FIG. 1 is a view of a hoop earring with the closure device in the closed position.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
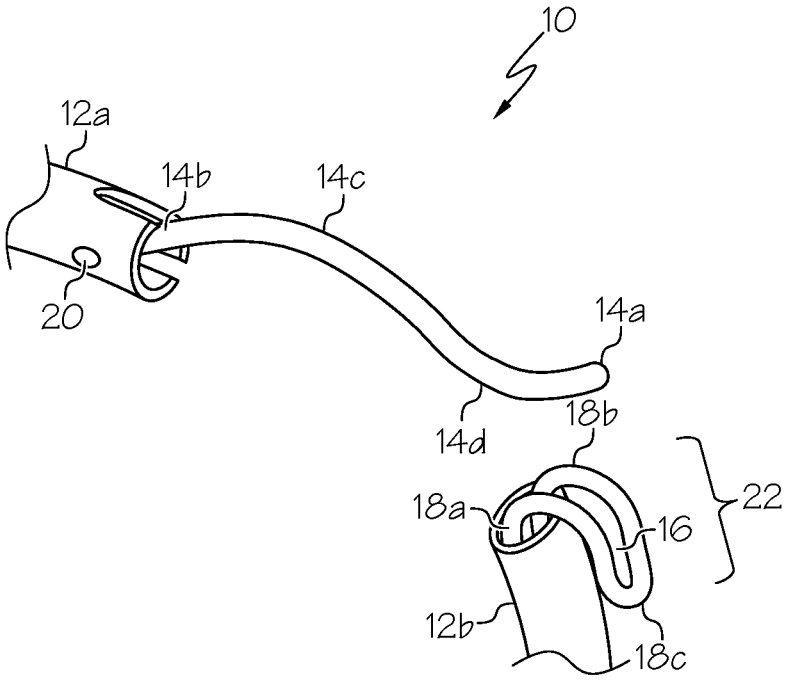
FIG. 2 is a close-up view of the 2 components of the Closure Device, the pivotal post and the compression split hook.
Figure 3:
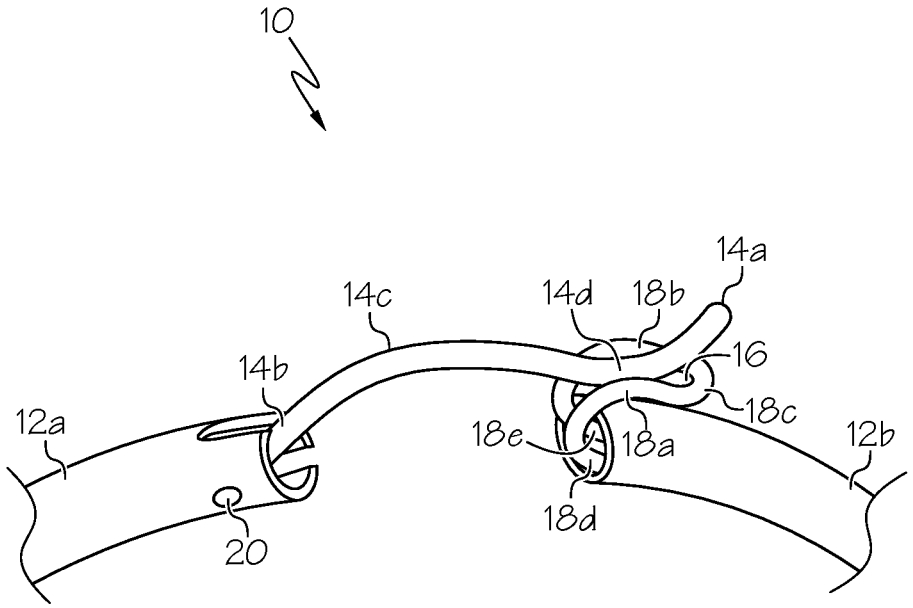
FIG. 3 is a close-up view of the pivotal post about to be entered into the compression split hook.

The invention provides closure devices 10 and methods securing an item of jewelry 12, and particularly hoop jewelry such as hoop earrings and bracelets, to a person who is a wearer of the jewelry. As shown in FIGS. 1-3, the closure device 10 closes a hoop of the item of jewelry by placing a pivoting post element 14 (e.g., by pressing with a finger) into a space 16 (referred to elsewhere herein as "a receiving aperture") on a latch 18 (also known as a compression hook). The item of jewelry 12 can be an earring, a bracelet, a necklace, or any other item of jewelry having a first end 12*a* and a second end 12*b* that require closure to secure the item of jewelry to a body part of the person, e.g., to the wearer's ear, neck, wrist, or ankle. In exemplary embodiments, the closure device 10 is incorporated as an integral part of an item of hoop jewelry 12 (e.g., a hoop earring or hoop bracelet), but may be incorporated in other types of jewelry that are not hoop-shaped such as, for example, chain jewelry.

The closure device 10 is incorporated into an item of jewelry 12, e.g., a hoop earring, a bracelet, an ankle bracelet, or a necklace. The item of jewelry 12 includes a first end 12*a* and a second end 12*b*, which when connected together by the closure device 10, serve to secure the item of jewelry to the body of the wearer. The closure device 10 can be oriented into an open configuration (as shown in FIG. 2) when removal of the item of jewelry 12 from a body of the wearer is desired and into a closed configuration (as shown in FIGS. 1 and 3) when securement to the body of the wearer is desired. Thus, the closure device 10, which is an integral part of the item of jewelry 12, is useful for securing the item of jewelry to the body of the wearer, e.g., through an ear piercing in the case of a hoop earring, around a neck of the wearer in the case of a necklace, or around the wrist or ankle of the wearer in the case of a bracelet or ankle bracelet. The closure device 10 includes a post element 14 and a latch 18.

The post element 14 of the closure device 10 is movably connected to a hinge 20 so as to be capable of pivoting forward and rearward on the hinge. The hinge 20 is attached to a first end 12*a* of an item of jewelry 12. In exemplary embodiments, the hinge 20 is attached horizontally through the first end 12*a* of the item of jewelry 12; however, in other embodiments, the hinge can be attached vertically or at some other angle through the first end of the item of jewelry. The post element 14 includes a free end 14*a* and a fixed end 14*b* that is connected to the hinge 20. In exemplary embodiments, the post element 14 is curved in shape, having one or more curves along its length. Such curves may have vertices that are located in opposing sides of an axis extending from the free end to the fixed end of the post element 14. In other embodiments, the post element 14 may be linear or straight in shape. The post element 14 can be a wire, for example, a generally linear wire or a wire with one or more curves along its length. The wire of the post element 14 can be circular, elliptical, triangular, square, rectangular, polygonal, rhomboidal, or any other desired shape in cross-section. In exemplary embodiments, the wire of the post element 14 is circular in cross-section.

In some embodiments, the post element 14 and hinge 20 are attached to the second end 12*b* of the item of jewelry 12, while the latch 18 is attached to the first end 12*a* of the item of jewelry.

The free end 14*a* of the post element 14 extends away from an outer surface 12*c* of the item of jewelry 12. The outer surface 12*c* of the item of jewelry 12 faces away from a space 12*d* that is defined by the item of jewelry when the closure device 10 is manipulated into a closed configuration. For example, in embodiments in which the item of jewelry 12 is a hoop earring, the space 12*d* is the (generally) circular space surrounded by an inner surface 12*e* of the hoop earring. The post element 14 is insertable through a piercing on the body of the person, e.g., an ear piercing, so that the post element resides in place through the piercing while the hoop earring extends from its first end and second end away from the post element at each respective side of the piercing.

In one exemplary embodiment, the post element 14 includes a first curved section 14*c* and a second curved section 14*d*. A vertex of the first curved section 14*c* extends in a first direction, while a vertex of the second curved section 14*d* extends in a second direction that is opposite to the first direction.

The latch 18 of the closure device 10 includes a first side wire 18*a* and a second side wire 18*b*, which are joined at a closed end 18*c* to form a loop 22. The latch 18 is attached to a second end 12*b* of the item of jewelry. (However, as mentioned elsewhere herein, in some embodiments, the post element 14 and hinge 20 are attached to the second end 12*b* of the item of jewelry 12, while the latch 18 is attached to the first end 12*a* of the item of jewelry.) A width of the loop 22 is less than a width of the post element 14. The closure device 10 secures the item of jewelry 12 to a person by removably but securely connecting between the first end 12*a* and second end 12*b* of the item of jewelry by fastening the post element 14 between the first side wire 18*a* and second side wire 18*b* of the latch 18 within the loop 22.

The first side wire 18*a* and the second side wire 18*b* of the latch 18 can be part of a single wire having a first free end 18*d* and a second free end 18*e*, wherein the first and second free ends are attached to the second end 12*b* of the item of jewelry 12 to form the loop 22. In exemplary embodiments such as the embodiment shown in FIGS. 1-3, the loop 22 can be U-shaped or V-shaped, and the closed end 18*c* of the loop 22 (which is also the closed end of the latch 18) can be oriented away from the post element 14. The closed end 18*c* of the loop 22 of the latch 18 can be oriented away from the first end 12*a* of the item of jewelry 12.

In one exemplary embodiment of the closure device 10, the first side wire 18*a* and the second side wire 18*b* of the latch 18 are part of a single wire having a first free end 18*d* and a second free end 18*e*. The first and second free ends 18*d*, 18*e* are attached to the second end 12*b* of the item of jewelry 12 to form the loop 22. Each of the first and second side wires 18*a*, 18*b* extend for first lengths away from their point of attachment to the second end 12*b* of the item of jewelry 12 toward the first end 12*a* of the item of jewelry. The first and second side wires 18*a*, 18*b* each curve at first points of their respective first lengths to form curved second lengths. The curved second lengths of the first and second side wires 18*a*, 18*b* each continue from second points to form third lengths oriented in a direction opposite to the direction of their respective first lengths. At third points, the third lengths curve at arcs in a plane that is perpendicular to planes extending through the first lengths and third lengths of each of the first and second side wires 18*a*, 18*b*. The third lengths connect together to complete the loop 22, thereby forming the closed end 18*c* of the latch 18.

As shown in FIG. 3, the loop 22 and closed end 18*c* of the latch 18 define a receiving aperture 16 into which the post element 14 is insertable to place the closure device 10 into a closed configuration, thereby closing the hoop of the item of jewelry 12 and removably securing the item of jewelry to the body of the wearer. In exemplary embodiments, for example as shown in FIG. 3, the second curved section 14*d* of the post element 14 is inserted into the receiving aperture 16 of the latch 18 to place the closure device 10 into the closed configuration. The width of the post element 14 at least where it is inserted into the receiving aperture 16 is greater than the width of the receiving aperture between the first and second side wires 18*a*, 18*b* of the latch 18. In some embodiments, the post element 14 is wider than the receiving aperture 16 only at a portion (e.g., the second curved section 14*d*) that contacts the first and second side wires 18*a*, 18*b* of the latch 18. In other embodiments, the post element 14 has the same width, which is wider than the width of the receiving aperture 16, along its entire length or at one or more of its sections. This difference in width of the post element 14 versus the receiving aperture 16 results in friction and pressure between surfaces of the post element that are in contact with surfaces of the first and second side wires 18*a*, 18*b* of the latch 18. The friction and pressure exerted by and between the first and second side wires 18*a*, 18*b* against the post element 14 retains the post element securely within the receiving aperture 16 of the latch 18 when the closure device 10 is in its closed configuration. Pressing up or pulling up on the free end 14*b* of the post element 14 frees the post element from the receiving aperture 16 when the closure device 10 is in its closed configuration reorients the closure device into its open configuration.

As shown in FIG. 1, the invention also features a combination item of jewelry with integrated closure device 100 that includes an item of jewelry 12 having a first end 12*a* and a second end 12*b* with a closure device 10 incorporated into a unitary piece with the item of jewelry. The closure device 10 of the combination 100 (also referred to hereafter simply as "the jewelry") also includes a post element 14 movably connected to a hinge 20, wherein the hinge is attached to the first end 12*b* of the item of jewelry. The closure device 10 of the jewelry 100 further includes a latch 18 having a first side wire 18*a* and a second side wire 18*b*, which are joined at a closed end 18*c* to form a loop 22. The latch 18 is attached to a second end 12*b* of the item of jewelry 12. A width of the loop 22 is less than a width of the post element 14. The closure device 10 secures the jewelry 100 to a person by removably but securely connecting between the first end 12*a* and second end 12*b* of the item of jewelry 12 by fastening the post element 14 between the first side wire 18*a* and second side wire 18*b* of the loop 22 of the latch 18. Other features of this combination item of jewelry and integrated closure device invention 100 are described elsewhere herein.

The invention also relates to methods of closing an item of jewelry having a first end and a second end such as any of the types of jewelry described elsewhere herein. The item of jewelry includes a closure device as described herein, which has a pivoting post element attached to a hinge at the first end of the item of jewelry, and a latch attached to the second end of the item of jewelry. The post element and latch can be constructed in any of the forms described herein. In one method, the post element is inserted through a piercing, e.g., an ear piercing through an ear of a wearer. Once passed through the piercing, the post element is secured to the latch by pressing a free end of the post element downward to a receiving aperture of the latch. Once pressed into the receiving aperture, a first side wire and a second side wire, which define the latch's receiving aperture, exert adequate pressure and frictional contact against left and right sides of the post element to hold the post element securely in position within the receiving aperture. In this manner, the closure device connects the first end and the second end of the item of jewelry to secure it (an earring in this example) in the piercing and to the ear of the wearer.

In the example above, the latch or the second end of the item of jewelry may also be pulled toward the post element at the same time that pressure is exerted downward against the post element to position it within the receiving aperture of the latch between the first and second side wires.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A closure device for securing an item of jewelry to a person, the closure device comprising:

a post element movably connected to a hinge, wherein the hinge is attached to a first end of an item of jewelry; and a latch comprising a first side wire and a second side wire, which are joined at a closed end to form a loop defining a receiving aperture, wherein the latch is attached to a second end of the item of jewelry;

wherein a width of the receiving aperture of the loop is less than a width of the post element;

wherein the closure device secures the item of jewelry to a person by removably but securely connecting between the first end and second end of the item of jewelry by fastening the post element between the first side wire and second side wire of the loop; and wherein the first side wire and the second side wire are part of a single wire comprising a first free end and a second free end; wherein the first and second free ends are attached to the second end of the item of jewelry to form the loop; wherein each of the first and second side wires extend for first lengths away from their point of attachment to the second end of the item of jewelry toward the first end of the item of jewelry; wherein the first and second side wires each curve at first points of their respective first lengths to form curved second lengths; wherein the curved second lengths of the first and second side wires each continue from second points to form third lengths oriented in a direction opposite to the direction of their respective first lengths; wherein at third points, the third lengths curve at arcs in a plane that is perpendicular to planes extending through the first lengths and third lengths of each of the first and second side wires; and wherein the third lengths connect together to complete the loop, thereby forming the closed end of the latch.

2. The closure device of claim 1, wherein the post element comprises a free end and a fixed end that is connected to the hinge.

3. The closure device of claim 1, wherein the post element comprises a generally linear wire.

4. The closure device of claim 1, wherein the post element comprises a first curved section and a second curved section, wherein a vertex of the first curved section extends in a first direction, and wherein a vertex of the second curved section extends in a second direction that is opposite to the first direction.

5. The closure device of claim 1, wherein a free end of the post element extends away from an outer surface of the item of jewelry, wherein the outer surface of the item of jewelry faces away from a space that is defined by the item of jewelry when the closure device is manipulated into a closed configuration.

6. The closure device of claim 1, wherein the hinge is attached horizontally through the first end of the item of jewelry.

7. The closure device of claim 1, wherein the loop is U-shaped or V-shaped; wherein the closed end of the loop is oriented away from the post element.

8. The closure device of claim 1, wherein the closed end of the loop of the latch is oriented away from the first end of the item of jewelry.

9. The closure device of claim 1, wherein the loop and closed end of the latch define the receiving aperture into which the post element is insertable to place the closure device into a closed configuration.

10. The closure device of claim 1, wherein the item of jewelry comprises an earring, a bracelet, a necklace, or any other item of jewelry comprising first and second ends that require closure to secure the item of jewelry to the person.

11. The closure device of claim 1, wherein the item of jewelry comprises an earring and wherein the post element is insertable through a piercing on the body of the person.

12. An item of jewelry comprising:

an item of jewelry comprising a first end a second end, and a closure device, the closure device comprising:

a post element movably connected to a hinge, wherein the hinge is attached to the first end of the item of jewelry; and a latch comprising a first side wire and a second side wire, which are joined at a closed end to form a loop defining a receiving aperture, wherein the latch is attached to a second end of the item of jewelry;

wherein a width of the receiving aperture of the loop is less than a width of the post element;

wherein the closure device secures the item of jewelry to a person by removably but securely connecting between the first end and second end of the item of jewelry by fastening the post element between the first side wire and second side wire of the loop; and wherein the first side wire and the second side wire of the latch are part of a single wire comprising a first free end and a second free end; wherein the first and second free ends are attached to the second end of the item of jewelry to form the loop; wherein each of the first and second side wires extend for first lengths away from their point of attachment to the second end of the item of jewelry toward the first end of the item of jewelry; wherein the first and second side wires each curve at first points of their respective first lengths to form curved second lengths; wherein the curved second lengths of the first and second side wires each continue from second points to form third lengths oriented in a direction opposite to the direction of their respective first lengths; wherein at third points, the third lengths curve at arcs in a plane that is perpendicular to planes extending through the first lengths and third lengths of each of the first and second side wires; and wherein the third lengths connect together to complete the loop, thereby forming the closed end of the latch.

13. The item of jewelry of claim 12, wherein the post element comprises a free end and a fixed end that is connected to the hinge.

14. The item of jewelry of claim 12, wherein the post element comprises a first curved section and a second curved section, wherein a vertex of the first curved section extends in a first direction, and wherein a vertex of the second curved section extends in a second direction that is opposite to the first direction.

15. The item of jewelry of claim 12, wherein a free end of the post element extends away from an outer surface of the item of jewelry, wherein the outer surface of the item of jewelry faces away from a space that is defined by the item of jewelry when the closure device is manipulated into a closed configuration.

16. The item of jewelry of claim 12, wherein the loop is U-shaped or V-shaped; wherein the closed end of the loop of the latch is oriented away from the first end of the item of jewelry.

17. The item of jewelry of claim 12, wherein the loop and closed end of the latch define the receiving aperture into which the post element is insertable to place the closure device into a closed configuration.

* * * * *